US005533633A

United States Patent [19]

King

[11] Patent Number: 5,533,633

[45] Date of Patent: Jul. 9, 1996

[54] CONTAINER CLOSURE ASSEMBLY

[75] Inventor: Roger M. King, Latimer Bucks, United Kingdom

[73] Assignee: Beeson and Sons Limited, United Kingdom

[21] Appl. No.: 288,075

[22] Filed: Aug. 10, 1994

[30] Foreign Application Priority Data

Aug. 13, 1993 [GB] United Kingdom ..... 9316834

[51] Int. Cl.[6] ..... B65D 41/36

[52] U.S. Cl. ..... 215/252; 215/330; 215/307; 220/296

[58] Field of Search ..... 215/307, 329, 215/330, 331, 222, 218, 252; 220/298, 293, 296, 374

[56] References Cited

U.S. PATENT DOCUMENTS

| | | | |
|---|---|---|---|
| D. 327,644 | 7/1992 | Offley et al. . | |
| D. 329,980 | 10/1992 | Powell et al. . | |
| 2,600,703 | 5/1946 | Strom | 220/298 |
| 2,623,657 | 8/1947 | Vries | 220/298 |
| 4,084,717 | 4/1978 | King . | |
| 4,275,817 | 6/1981 | Patton | 215/330 X |
| 4,387,817 | 6/1983 | Wiles et al. . | |
| 4,392,055 | 7/1983 | Whitney . | |
| 4,444,327 | 4/1984 | Hedgewick | 215/222 X |
| 4,456,137 | 6/1984 | Lyman . | |
| 4,553,678 | 11/1985 | Thorsbakken | 215/218 |
| 4,669,624 | 6/1987 | Wiles et al. . | |
| 4,799,597 | 1/1989 | Mayes et al. | 215/330 X |
| 4,936,474 | 6/1990 | Szczesniak et al. | 215/330 X |
| 5,135,124 | 8/1992 | Wobser | 215/222 |
| 5,213,225 | 5/1993 | King et al. . | |
| 5,219,084 | 6/1993 | King . | |
| 5,320,233 | 6/1994 | Welch | 215/331 X |

FOREIGN PATENT DOCUMENTS

| | | |
|---|---|---|
| 0227203 | 7/1987 | European Pat. Off. . |
| 261370 | 5/1927 | United Kingdom . |
| WO91/18799 | 12/1991 | WIPO . |
| WO93/01098 | 1/1993 | WIPO . |
| WO94/11267 | 5/1994 | WIPO . |

*Primary Examiner*—Allan N. Shoap
*Assistant Examiner*—Nathan J. Newhouse
*Attorney, Agent, or Firm*—Brinks Hofer Gilson & Lione

[57] ABSTRACT

A container and closure assembly for storing fluids under pressure has cooperating screw threads on the neck of the container and the closure. Mutually engageable elements on the neck and closure block the rotation of the closure in the unscrewing direction beyond an intermediate position when the closure is under pressure. The neck of the container and the closure are constructed to provide a vent for releasing this pressure to allow the closure to be fully removed.

20 Claims, 3 Drawing Sheets

CONTAINER CLOSURE ASSEMBLY

This invention relates to a container closure assembly. In particular it relates to such an assembly for pressurised containers, and it is especially suitable for containers for carbonated, fizzy and pressurised drinks as well as any liquids or other contents which may be under pressure in a container.

In certain circumstances high internal pressures can force conventional closures violently from the neck, and this risks injury or damage. This can be a particular problem when, for example, a fizzy drinks container is opened for the first time. The contents are often highly pressurised so that the drink will retain a good "fizz". The pressure can often dramatically increase if the container has been heated up or knocked or shaken prior to opening. The problem is made worse in closure assemblies employing short screw threads or fast pitch threads such as 90° closure threads, since such designs are intended to make the closure easy to remove from the neck.

The present invention provides a container closure assembly for storing solids or fluids under pressure, said assembly comprising:

a container neck;

a closure for said neck;

a first screw thread on one of said neck and closure;

a second screw thread on another of said neck and closure; said second screw thread being engageable with said first screw thread;

means for forming a seal between said neck and closure when said closure is screwed down on said neck;

mutually engageable elements on said neck and closure to block or restrict rotation of said closure in an unscrewing direction beyond an intermediate position when said closure is under an axial pressure in a direction emerging from said container neck;

wherein said neck and closure are constructed and arranged to provide a vent for venting gas from said container neck at least when said closure is in said intermediate position.

Preferably, the thread on one of the neck and closure has a wider portion at the end adjacent to its respective opening, and the thread of the other of the neck and the closure is narrower than the thicker portion of the other thread, whereby when the closure is removed from the closed position, pressure is released through the space between the threads on said one of the neck and the closure.

It can be seen that the present invention solves the above-stated technical problem by the provision of blocking means on the neck and closure to block temporarily the unscrewing of the closure at a partially unscrewed position while excess pressure is allowed to vent from inside the container. The stop means is configured such that the force required to unblock the closure from its intermediate position increases with increasing gas pressure in the container. Preferably, the screw threads on the container neck and closure are dimensioned such that a helical venting pathway is left between the neck and closure threads, whereby excess pressure inside the container vents out between the said threads as soon as the seal between the container and closure is broken, but before unscrewing of the closure is completed. More preferably, venting takes place along a path between the screw threads while the closure is blocked by the blocking means at its intermediate safety position. Preferably, transverse notches are provided through the threads on the neck and the closure, of the kind conventionally known in the art, to provide additional gas venting in the intermediate position.

Such arrangements avoid any tendency for the internal pressure to force the closure off the container neck once a person has begun to unscrew the closure and before venting of excess gas from the container is complete.

The invention has been devised such that it is especially suitable for carbonated beverage containers however, it will be appreciated that the invention may find use as a pressure safety closure in other fields relating to pressurised closure assemblies.

Preferably, the means for permitting rotation and for blocking or restricting rotation beyond the intermediate position does not act to block or restrict rotation of the closure when it is not substantially under axial pressure in a direction emerging from the container neck. In this way, the pressure safety feature is pressure responsive, and does not block rotation of the closure when opening or closing the container when the closure is not under pressure, for example, when the contents of the container have become substantially or completely depressurised.

Preferably, the arrangement of at least a portion of the screw thread on the closure and at least a portion of the screw thread on the neck is such as to permit limited axial movement or displacement of the closure relative to the neck without rotation of the closure when the closure is near or at the intermediate position on the neck. With such an arrangement, any internal pressure in the container will tend to "lift" or displace the closure axially in a direction emerging from the container neck.

Preferably, the means for permitting rotation and for blocking or restricting rotation beyond the intermediate position is responsive to axial displacement of the closure, as allowed by the threads when the closure is near or at the intermediate position. Preferably, the blocking or restricting action comes into effect when the closure is displaced axially in the direction emerging from the container neck, and the blocking or restricting action does not take effect when the closure is not displaced in the direction emerging from the container neck. Preferably, the blocking or restricting action can only be overcome or released by applying an external downward axial force to the closure to counter the internal pressure displacing the closure axially upward, whereby the closure is moved back into its non-displaced condition. The closure can then easily be unscrewed past the intermediate position to open the container.

Such an arrangement is therefore responsive not only to internal pressure acting on the closure, but also to external pressure applied by the person unscrewing the closure. The safety feature is in one respect dependent on the strength of the person unscrewing the closure. For example, a child might be at most risk with a conventional closure because he might not be able to grip the closure very tightly, and a conventional closure might spin off uncontrollably under high pressure. However, with the arrangement described above, the closure will be held at the intermediate position until the internal pressure has reduced to a low level at which the child can release the closure. On the other hand, a relatively strong adult might be less at risk than a child with a conventional closure because an adult would have a stronger grip to prevent a conventional closure from spinning off uncontrollably. In a similar fashion an adult would also be able to exert a greater external downward axial force to release the blocking effect of the invention at an earlier stage. Nevertheless, should the closure begin to spin uncontrollably when it is first unscrewed, the arrangement will act to hold the closure at the intermediate position until the pressure is reduced.

Preferably the means for permitting rotation and for blocking or restricting rotation of the closure comprise at least one first element on the neck which is engageable with at least one second element on the closure to form an abutment stop.

Preferably the means for permitting rotation and for blocking or restricting rotation of the closure are formed integrally with, or as part of, the screw thread on the neck and/or with the screw thread on the closure.

Preferably, the mutually engageable elements comprise a step or recess formed in the side of the first or second screw thread to provide an abutment surface against which the second or first thread abuts to block or restrict rotation of the closure in an unscrewing direction at the intermediate position when the closure is under axial pressure from the contents of the container. More preferably, complementary steps or recesses for mutual abutment are provided on both of the first and second screw threads.

In the preferred embodiment, a first screw thread is carried on one of the neck and the closure, and a second screw thread is carried on the other of the neck and the closure. The first thread is formed with a step profile along at least one edge, in order to provide a first abutment surface to engage a portion of the second thread when the closure is unscrewed and is displaced axially in a direction emerging from the container neck, and the second thread has generally smooth edges, and one end of the second thread acts as a second abutment surface to engage the first abutment surface.

A preferred feature in the embodiment is that the aforementioned abutment surfaces are not flat, but instead are preferably formed with complementary indented (eg. concave) and projecting (eg. convex) surfaces at least in an axial plane, to nest one within the other whilst at the same time providing profiles to assist smooth opening when the pressure is released. For example, the first abutment surface of the first thread may be curved or angled to be flat or concave, and the second abutment surface of the closure thread may comprise a convex end surface of the closure thread. Such an arrangement provides an additional safety feature in preventing the possibility that the abutment surfaces might, under strong pressure or with wear, creep past one another to allow the closure to rotate past the intermediate position. The nesting of one abutment surface within the other provides a hook to locate the surfaces together positively, and the positive locating effect will be stronger the higher the internal pressure to which the closure is subjected.

Preferably, the screw thread on the container neck is integrally formed in two portions. The first portion, adjacent the top of the container has a first, wide cross-section. The second portion below the first portion has a second, narrower cross-section. The transition between the first and second portions provides a step on the lower surface of the neck thread against which an end of the closure thread abuts when the closure is unscrewed under axial pressure from gas inside the container. The upper surface of the neck thread is substantially continuous, whereby unscrewing of the closure (and screwing down of the closure) proceeds smoothly in the absence of axial pressure from inside the container.

The container closure assembly may include means for restricting or blocking rotation at a plurality of intermediate positions between the closed position of the closure and its fully released position.

The container and closure assembly of this invention may comprise only single start screw threads, or it may preferably comprise multi-start screw threads. More preferably, the screw threads comprise four starts. In such a case, the means for permitting rotation and for restricting or blocking rotation beyond the predetermined position may be associated with all of the screw threads in the multi-start arrangement, or it may be associated with only one or some of the threads. In the preferred embodiment, a respective means for permitting rotation and for restricting or blocking rotation is provided for each thread segment of multi-start threads.

The means for venting internal pressure when the closure is in its intermediate position may comprise means for allowing the pressure to escape between the neck and the closure, for example, by passage through or around the screw threads. In the preferred embodiment, the arrangement of the threads provides a clear escape passage along a helical path between the threads when the closure is being restrained at it intermediate position. Preferably, a further gas venting path is provided by means of transverse gas venting grooves extending across the neck and closure threads, as is conventionally known in the art.

Preferably, the first thread includes first thread portions at least parts of which are separated by a first thread spacing having a first cross-sectional area, and the second thread includes second thread portions having a second cross-sectional area smaller than the first cross-sectional area, thereby providing a vent clearance between the first and second threads to permit venting of internal pressure from the container along a path between the first and second threads.

Additionally or alternatively, mutually alignable venting passages similar to those conventionally used in carbonated beverage container closure assemblies may be provided in the closure and the neck threads to allow the pressure to escape when the passages are aligned. Such venting passages may be provided in segments of the screw threads, the passages becoming aligned when the closure reaches the intermediate position.

The gas pressure release means and intermediate blocking means according to the present invention is especially useful in conjunction with closures that are screwed completely onto the container neck by rotation through about 90° or less. Such closures have steeply pitched threads that are more prone to blow off under pressure than multiple-turn threads. The steep pitch of such threads can also cause problems because the closures can work loose during handling of the container closure assembly, especially if the contents of the container are pressurised. Therefore, the container closure assembly according to the present invention preferably comprises locking means on the container and closure to retain the closure tightly on the container neck until a positive unscrewing torque is applied to the closure. Preferably, the locking means comprises a plurality of locking elements on the container neck and a plurality of axial locking ribs on the inside of the skirt of the closure. More preferably, the locking elements have a locking surface that is inclined at an angle to a radius of the container neck and the locking rib rests on the said surface when the closure is in the closed position, whereby pressure between the locking rib and the said surface tends to urge the closure into the closed position. This helps to ensure a gas-tight seal between the closure and the container neck. Such locking and urging means are described in detail in international patent application no. PCT/GB92/01255 (published as WO93/01098), incorporated herein by reference.

The neck of the container preferably has a smooth and slightly rounded lip to permit drinking directly from the container. Preferably, a gas-tight seal between the neck and the closure in the screwed-down position is formed by abutment between this lip and the inside of the base of the closure. In order to allow for slightly variable manufacturing tolerances, the inside of the base of the closure is preferably provided with a compressible gas-tight wad, or a layer of gas-tight elastomer, to assist in making the said gas-tight seal. Alternatively, or additionally, other gas-tight seals may be formed between the container and the closure, e.g. interference fit seals, 0-ring seals, or plug seals formed by plugs depending from the base of the closure and sealing against an inner surface of the neck, as commonly known in the art.

In other preferred embodiments, the assembly further comprises a circumferential sealing rib of substantially triangular cross-section projecting from a first surface on the neck or closure for abutment against a second surface on the closure or the neck to form a pressure-tight seal therewith when the closure is screwed down. The sealing rib may, for example, project upwardly from the lip of the container neck for abutment against the base of the closure. Preferably, the sealing lip projects outwardly from a side surface of the neck, or projects inwardly from a side surface of the closure. In that case, the first and/or second surface is preferably tapered (i.e. chamfered or bevelled) an angle of from 2° to 20° from the longitudinal axis of the assembly. This results in an improved pressure-tight seal when the closure is screwed down.

Preferably, the sealing rib has a height of from 0.025 mm to 0.25 mm.

Preferably, the sealing rib projects outwardly from the lip of the container neck. This enables the sealing rib also to function as a drip reducer when liquids are poured from inside the container. More preferably, one side of the triangular cross-section of the sealing rib is substantially flush with the top of the container neck and preferably also perpendicular to the longitudinal axis of the container neck.

The first and second screw threads may be of square or rectangular or rounded cross section, as commonly known in the art. Preferably, at least part of at least one of the neck and closure screw threads has a substantially triangular cross-section, since such cross-sections are easy to bump off a mould when the container and closure are formed by automated mass-production injection moulding or blow-moulding.

The invention may additionally include any of the features described in our published International patent applications Nos. PCT/GB91/00850 (published as WO-A-91/18799) and PCT/GB92/01255 (published as WO-A-93/01098), and in our United Kingdom patent applications 9223779.1 and 9226320.1. The contents of these documents are included herein by way of reference. In particular, the closure may be securable or removable by relative rotation of about 360° or less, or preferably about 180° or less, or most preferably about 90° or less.

Specific embodiments of the invention will now be described by way of example with reference to the accompanying drawings in which.

Figure 2:
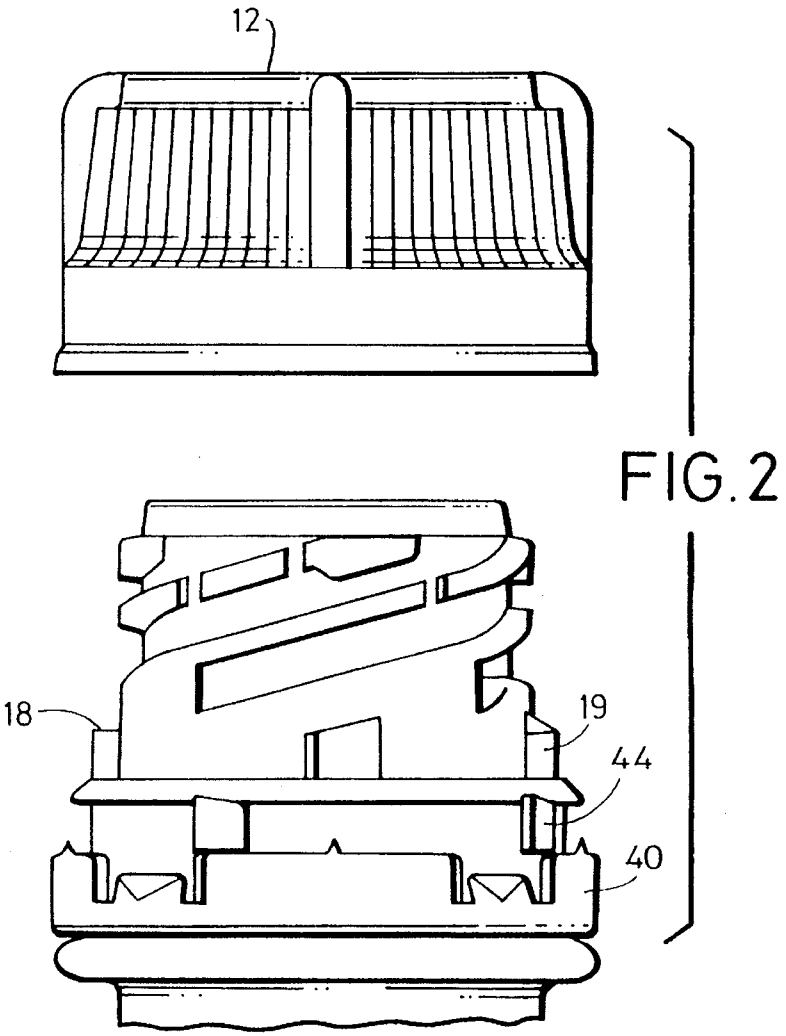
FIG. 2 shows a side elevation view of the container closure assembly of FIG. 1 after removal of the closure.
Figure 1:
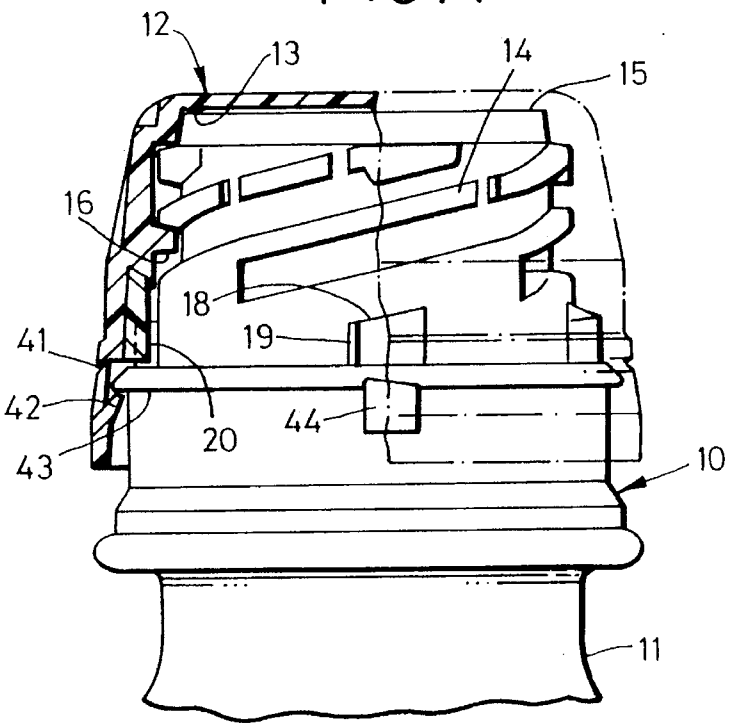
FIG. 1 shows a side elevation view of a container closure assembly according to the present invention with the closure screwed down in the sealing position. The closure is shown partly cut away and partly in cross-section.

Referring to FIG. 1, the assembly includes a container neck 10 of a container 11 for carbonated beverages, and a closure 12, both of plastics. The container 11 and closure 12 are formed by blow moulding and injection moulding from PET and polyethylene respectively, in known fashion. The neck carries a four-start first screw thread 14, and the closure carries a corresponding four start second screw thread 16. In this particular embodiment the threads have square or rectangular cross section. The detail of these threads will be described below. The threads provide approximately a quarter turn (90°) of rotation of the closure 12 relative to the neck 10 to move the closure from fully closed to fully released.

The assembly includes locking means to retain the closure 10 positively in its fully closed position on the neck. The locking means comprise a pair of neck elements 18 spaced at 180° and projecting radially outwardly from the neck and which are engageable with respective ones of four axial closure ribs 20 which project radially inwardly from an inner surface of the closure 10. The detail of such locking means is described in our published patent applications Nos. PCT/GB91/00850 (published as WO-A- 91/18799) and PCT/GB92/01255 (published as WO-A-93/01098). The locking means can be overcome by application of an external torque in a direction to unscrew the closure. In this exemplary embodiment, the locking elements 18 have respective abutment surfaces 19 which are inclined relative to the radial direction in order to provide a resilient carrying action to urge the closure 12 into its fully closed position.

The assembly also includes sealing means to form a pressure-tight seal between the closure 12 and the neck 10 when the closure is in its fully closed position. The sealing means comprises a layer of elastomer 13 of the type conventionally used in this art provided on the inside surface of the base of the closure 12. The layer 13 of elastomer presses against a top surface 15 of the neck 10 to form a gas-tight seal. Even very slight unscrewing of the closure will release this seal and allow gas from inside the container 11 to vent past the screw threads 14,16 to the atmosphere.

The container closure assembly is also provided with a tamper-evident ring 40 of the type described and claimed in our international patent application PCT/GB93/02341, the entire content of which is incorporated herein by reference. Briefly, the tamper evident ring 40 is provided with frangible joints 41 to the closure 12 and with flexible tabs 42 that abut against the underside of a flange 43 on the container neck. The flexibility of the tabs 42 allows the tamper-evident ring to snap over the flange on the container neck when the closure is first screwed down onto the container neck. However, unscrewing the closure cap causes the closure cap and tamper-evident ring to separate at the frangible joints 41. To ensure that this separation occurs, ratchet means 44 are provided on the container neck below the flange 43 to block rotation of the tamper evident ring in the direction of unscrewing of the closure, and thereby apply a torsional force as well as tension across the frangible joints 41 when the closure is unscrewed.

The assembly includes a safety feature to prevent the possibility that the closure 10 might spin off controllably under the internal pressure when a person begins to unscrew the closure. In this embodiment, the safety feature is provided by the arrangement of the threads 14 and 16, as best seen in FIGS. 3 to 5.

Each thread segment of the neck thread 14 has a generally wide first portion 30 at its end closest to the open end 24 of the neck 10, and a relatively narrow second portion 32 which extends below the wide portion. The region joining the wide portion 30 to the stem portion 32 is formed generally with a step profile on its lower side to define a first abutment surface 34. The abutment surface includes a recess in the form of a concave profile (viewed in an axial plane). The outermost corner 36 of the abutment surface acts as a locating lip. The upper surface of the neck thread segment is smooth and continuous between said first and second portions.

Each thread segment of the closure thread 16 is shorter than the corresponding segment of the neck thread 14, and has generally straight and parallel sides and rounded ends. The width of each segment of the closure thread is approximately the same as that of the narrow second portion 32 described above. The rounded end 38 of each closure thread segment which is remote from the open end of the closure 12 acts as a second abutment surface for engagement with the first abutment surface 34 of the neck thread.

Figure 3:
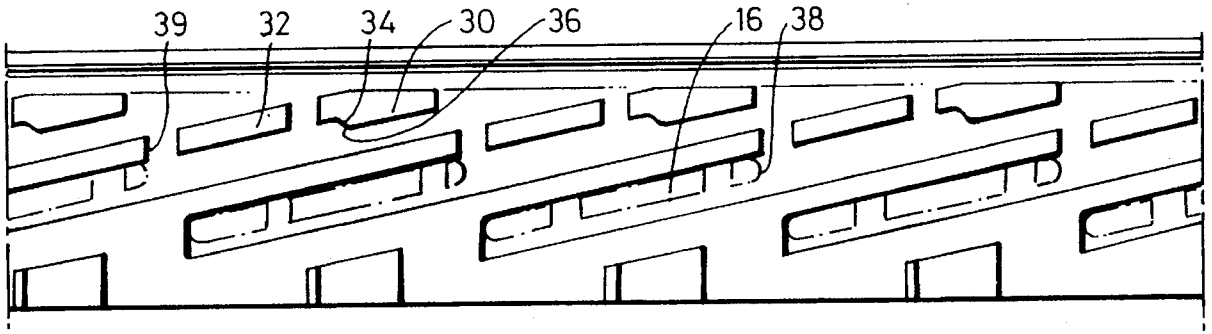
FIG. 3 shows a plane projection of the screw threads of the container neck of FIG. 1, with the screw threads of the closure shown in phantom and the closure in the screwed down, sealing position.
Figure 4:
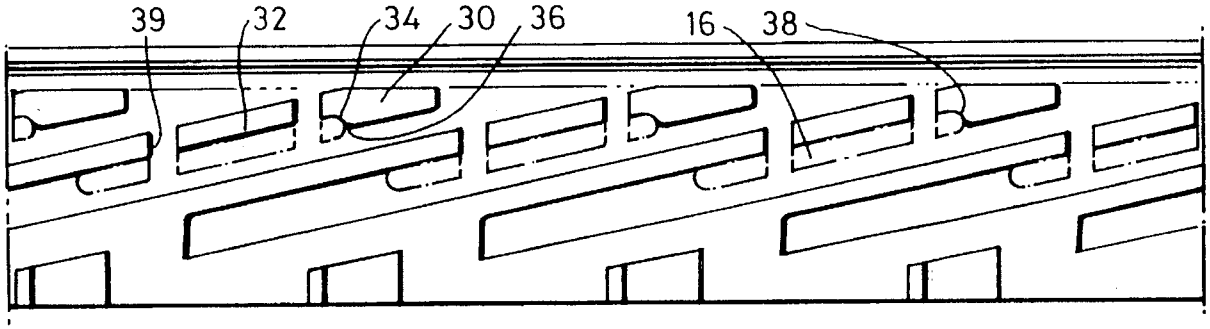
FIG. 4 shows a similar projection to FIG. 3, but with the screw threads of the closure in the partially unscrewed, blocked, gas-venting position.
Figure 5:
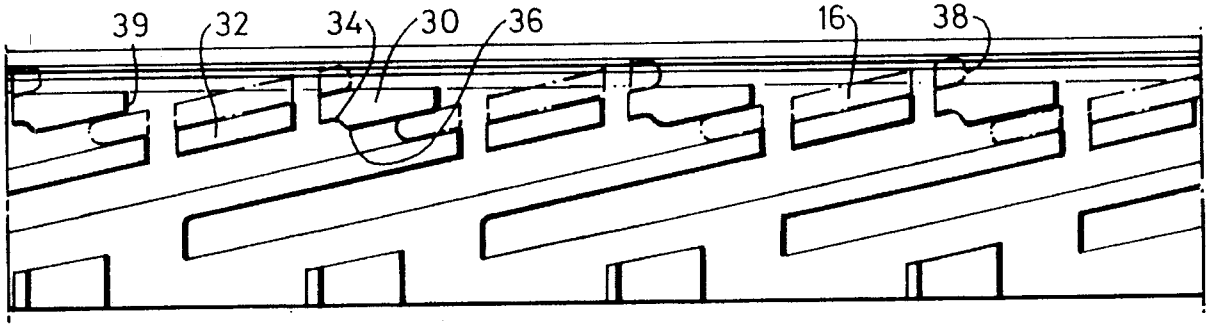
FIG. 5 shows a similar projection to FIGS. 3 and 4, but with the screw threads of the closure in the unblocked screwing/unscrewing position.

As best seen in FIGS. 3 to 5, the spacing of the second portions 32 of adjacent segments of the neck thread 14 is greater than the cross-sectional width of the closure thread segments. This permits a limited amount of axial movement of the closure 12 on the neck 10 when the closure is in a rotational position such that the closure thread segments are between the second portions 32 of adjacent neck thread segments. However, the spacing between the first portions 30 of adjacent neck thread segments is just wide enough to pass the closure thread segment (see FIG. 5) but not wide enough to permit substantial axial movement without rotation.

In use, when closure 12 is in its closed position, the arrangement of the threads will be as illustrated in FIG. 3. If there is little or no pressure in the container, then as the closure is unscrewed, the closure thread segments will move initially in a circumferential direction until they bear against the smooth upper surfaces of the neck thread segments (see FIG. 3), after which the closure thread segments will ride up the smooth upper surfaces of the neck thread segment (see FIG. 5) allowing the closure 12 to be unscrewed freely from the neck 10.

However, if the container contents are pressurised, then when the closure is unscrewed initially, the internal pressure will act on the closure to "lift" or displace the closure 12 axially in a direction emerging from the neck 10, such displacement being allowed by the relatively wide spacing of the second portions 32 of the adjacent neck thread segments. Therefore, the closure thread segments will remain in contact with the underside of the first thread segments. From the moment the closure is moved from the closed position (FIG. 3), a clear vent passage is created between the threads to release pressure. If the closure continues to be unscrewed while under pressure, or if the internal pressure is large enough to cause the closure to begin to unscrew itself, then the end surfaces 38 of the closure thread segments will come into engagement with the abutment surfaces 34 of the neck thread segments thereby to block further rotation of the closure in the unscrewing direction (see FIG. 4).

Thereafter, the closure 12 will be held in an intermediate position on the container neck 10. The convex shape of the upper ends of the closure threads 16 nests within the recessed concave shape of the abutment surface 34. This provides a positive locating effect to prevent any tendency for the neck and closure threads 14 and 16 to ride past each other, for example, under extreme internal pressure. It will be appreciated that the positive locating effect will be stronger the higher the internal pressure acting on the closure. The positive locating effect will also depend on the exact shape of the abutment surface 32 on the neck threads.

When the threads are in the condition shown in FIG. 4, the closure 12 will be lifted sufficiently above the container neck to release the seal formed by the first and second sealing surfaces, and the ridge. The internal pressure is vented by allowing gas to escape between the neck and the closure. As best seen in FIG. 4, the clear passage referred to already exists between the threads 14,16 of the neck and the closure, through which the pressure can escape. Additional vent passages 39 are provided in the segments of the neck thread 14 and in the segments of the closure thread 16. The additional vent passages 39 are arranged such that they become aligned when the threads are as shown in FIG. 4 to provide a further route through which gas can escape.

Once the internal pressure has dropped to a safe level, the closure 12 can be rotated to move the neck thread segments past the projecting corners 36 of the closure thread segments. The size and shape of the projecting corners 36 control how difficult or easy it will be for a person to release the first and second abutment surfaces 34 and 38 from engagement. For example, it may be necessary to press the closure axially towards the container to release the engagement of the second abutment surface 38 against the first abutment surface 34. The closure 12 may also drop down automatically under gravity when the internal pressure is no longer great enough to maintain it in its displaced condition.

Figure 6:
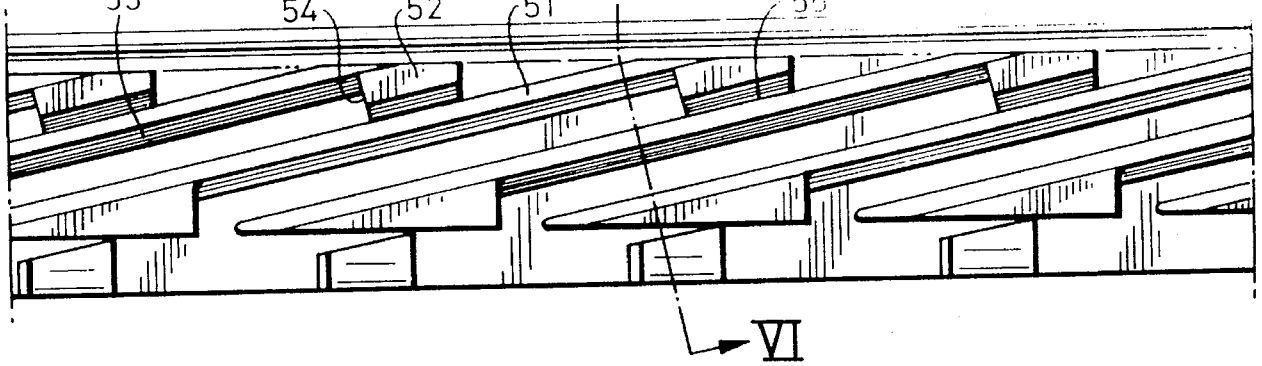
FIG. 6 shows a projection similar to FIGS. 3–5 of the neck of a second embodiment of the present invention having triangular/trapezoidal screw threads.

Referring now to FIG. 6, a second embodiment of the present invention has triangular cross section threads on at least part of the container neck and closure. The closure threads are not shown in FIG. 6 for the sake of clarity. Likewise, vent passages similar to the vent passages 39 shown in FIGS. 1–5 have been omitted for the sake of clarity. The neck threads 51 are arranged to provide a four-start one-quarter turn closing action. The neck threads 51 each comprise an upper portion 52 having a substantially trapezoidal cross section and a lower portion 53 having substantially triangular cross section. A step 54 between the upper and lower portions of the thread 51 on the lower side of the thread 51 provides an abutment surface for abutment against an end of the substantially triangular cross section closure thread when the closure is partially unscrewed under pressure from the contents of the container. The first portions 52 of the neck threads 51 abut radially around the neck to define grooves 55 along which the triangular cross section neck threads slide when removing the closure after the pressure inside the container has been released.

Figure 7:
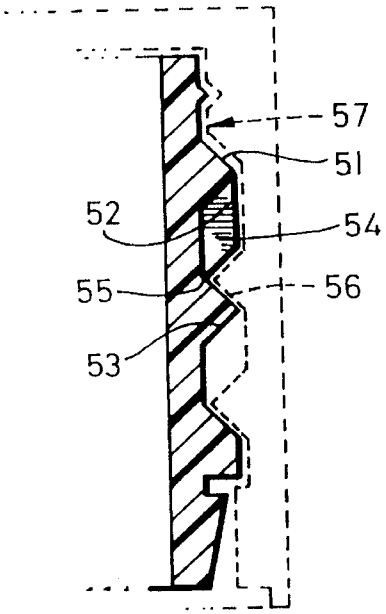
FIG. 7 shows a cross section through the neck and closure of the embodiment of FIG. 6 taken perpendicular to the threads.

The trapezoidal shape of the first thread portions 52 and the triangular grooves 55 are shown more clearly in cross section in FIG. 7. This drawing also shows the triangular cross section threads 56 of the closure 57 located in the grooves 55.

Although the container neck and closure referred to in the above embodiments are made of plastics, it will be appreciated that one or both of the neck and closure may be made from other materials. For example, the neck may be of glass; the closure may be of metal.

It will further be appreciated that although the above embodiment employs a seal turned between the lip of the container neck and a layer of elastomer in the base of the closure, other sealing means might be employed in modified embodiments.

It is emphasised that the above description is merely illustrative of a preferred embodiment of this invention, and that modification of detail may be made without departing from the scope and principles of this invention.

I claim:

1. A container closure assembly for storing fluids under pressure, said assembly comprising:

a container neck;

a closure for said neck;

a first screw thread on one of said neck and closure;

a second screw thread on another of said neck and closure; said second screw thread being engageable with said first screw thread;

means for forming a seal between said neck and closure when said closure is screwed down on said neck;

mutually engageable elements on said neck and closure to block or restrict rotation of said closure in an unscrewing direction beyond an intermediate position when said closure is under an axial pressure in a direction emerging from said container neck;

wherein said neck and closure are constructed and arranged to provide a vent for venting fluid from said container neck at least when said closure is in said intermediate position; and wherein the first screw thread comprises a plurality of first thread segments and the second screw thread comprises a plurality of second thread segments that are movable along a continuous helical thread path defined between axially adjacent first thread segments, and at least one of said plurality of said second thread segments simultaneously overlaps portions of two axially adjacent first thread segments along at least part of said continuous helical thread path, whereby the closure can be moved from a fully released to a fully closed position on the neck by a single smooth rotation through 360° or less.

2. An assembly according to claim 1, wherein said first and second screw threads are constructed and arranged to permit axial displacement of said closure relative to said neck at least when said closure is at said intermediate position, and wherein said engageable elements are adapted to engage each other when said closure is axially displaced in a direction emerging from said neck.

3. An assembly according to claim 2, wherein said engageable elements are constructed and arranged not to mutually engage each other when said closure is axially displaced in a direction inwardly towards said neck.

4. An assembly according to claim 1, wherein said mutually engageable elements comprise a step or recess formed in the side of said first or second screw thread to provide a first abutment surface against which a second abutment surface on said second or first screw thread abuts to block or restrict rotation of said closure in an unscrewing direction at said intermediate position when said closure is under axial pressure in a direction emerging from the container neck.

5. An assembly according to claim 4, wherein complementary steps or recesses for mutual abutment are provided on both of said first and second screw threads.

6. An assembly according to claim 4, wherein said first thread comprises a first thread portion having a first cross section and a second thread portion having a second cross section narrower than said first cross section, whereby a step is provided in a side of said first thread where said first and second thread portions meet, said first abutment surface being provided by said step.

7. An assembly according to claim 6, wherein said first thread is a thread on the neck of the container, said neck having an opening at the top of the neck, said first thread portion being above said second thread portion on said neck and said step being defined in a lower side of said first thread where said first and second thread portions meet.

8. An assembly according to claim 7, wherein an upper side of said first thread opposite said lower side of said first thread is substantially smooth and continuous where said first and second thread portions meet.

9. An assembly according to claim 6, wherein said first thread portion has a substantially trapezoidal cross-section and said second thread portion has a substantially triangular cross section.

10. An assembly according to claim 1 further comprising locking means on said container and said closure to prevent accidental unscrewing of the closure from the screwed-down position.

11. An assembly according to claim 10, wherein said locking means comprises a longitudinal locking rib on said container or said closure for engaging with a complementary locking recess on said closure or said container when said closure is screwed down onto said neck.

12. An assembly according to claim 1, further comprising a circumferential sealing rib of substantially triangular cross-section projecting from a first surface of said neck or said closure for abutment against a second surface of said closure or said neck when said closure is screwed down.

13. An assembly according to claim 12, wherein said first second surface is tapered at an angle of from 2° to 20° to the longitudinal axis of the container neck.

14. An assembly according to claim 13, wherein said second surface is tapered at an angle of from 2° to 20° to the longitudinal axis of the neck.

15. An assembly according to claim 12, wherein said sealing rib projects outwardly from the lip of the neck of the container, whereby said sealing rib also functions as a drip reducer when liquids are poured from the container.

16. An assembly according to claim 15, wherein the sealing rib has a substantially triangular cross section such that one side of the triangle is substantially flush with the top of the container neck and perpendicular to the longitudinal axis of the container neck.

17. An assembly according to claim 1, wherein at least one of said first and second threads has at least two thread starts.

18. An assembly according to claim 17, wherein at least one of said first and second threads has four thread starts.

19. An assembly according to claim 12, wherein said second surface is tapered at an angle of from 2° to 20° to the longitudinal axis of the neck.

20. A container closure assembly comprising:

a container neck;

a closure for said neck;

a first screw thread on one of said neck;

a second screw thread on said closure, said second screw thread being engageable with said first screw thread;

means for forming a seal between said neck and closure when said closure is rotated into a closed position on said neck;

said first and second threads being constructed and arranged to permit axial displacement of said closure relative to said neck when said closure is at an intermediate position on said neck, said intermediate position being between said closed position and fully disengaged;

mutually engageable elements on said neck and closure for blocking or restricting rotation of said closure beyond said intermediate position when the closure is in an axially displace condition in a direction emerging from said container neck;

at least one vent for venting internal pressure from said container neck at least when said closure is in its displaced condition at said intermediate position; and wherein the first screw thread comprises a plurality of first thread segments and the second screw thread comprises a plurality of second thread segments that are movable along continuous helical thread path defined between axially adjacent first thread segments, and at least one of said plurality of said second thread segments simultaneously overlaps portions of two axially adjacent first thread segments along at least part of said continuous helical thread path, whereby the closure can be moved from a fully released to a fully closed position on the neck by a single smooth rotation through 360° or less.

* * * * *

UNITED STATES PATENT AND TRADEMARK OFFICE

CERTIFICATE OF CORRECTION

PATENT NO. : 5,533,633
DATED : July 9, 1996
INVENTOR(S) : King

It is certified that error appears in the above-identified patent and that said Letters Patent is hereby corrected as shown below:

In Claim 20, line 19, replace "displace" with --displaced--.

In Claim 20, line 27, after "along" insert --a--.

Signed and Sealed this

Seventh Day of April, 1998

Bruce Lehman

*Attest:*

BRUCE LEHMAN

*Attesting Officer*

*Commissioner of Patents and Trademarks*